US012709861B2

(12) United States Patent
Streck et al.

(10) Patent No.: US 12,709,861 B2
(45) Date of Patent: Aug. 18, 2026

(54) ATTACHMENT FRAME WITH PIVOTING LOADER ARM

(71) Applicant: The Charles Machine Works, Inc., Perry, OK (US)

(72) Inventors: Todd J. Streck, Marshall, OK (US); Mark W. Kiner, Perry, OK (US); Michael D. Buck, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 358 days.

(21) Appl. No.: 18/364,623

(22) Filed: Aug. 3, 2023

(65) Prior Publication Data

US 2024/0068195 A1 Feb. 29, 2024

Related U.S. Application Data

(60) Provisional application No. 63/513,469, filed on Jul. 13, 2023, provisional application No. 63/395,517, filed on Aug. 5, 2022.

(51) Int. Cl.
*E02F 3/34* (2006.01)
*E02F 3/42* (2006.01)

(52) U.S. Cl.
CPC ..... *E02F 3/3417* (2013.01); *E02F 3/422* (2013.01)

(58) Field of Classification Search
CPC ..... E02F 3/30; E02F 3/308; E02F 3/32; E02F 3/325; E02F 3/3405; E02F 3/3408; E02F 3/3411; E02F 3/3417; E02F 3/422; E02F 3/436; E02F 9/0841
See application file for complete search history.

(56) References Cited

U.S. PATENT DOCUMENTS 2,753,060 A * 7/1956 Lull ..... E02F 3/3408 414/707
3,703,973 A * 11/1972 Nilsson ..... E02F 3/308 414/707
3,952,890 A * 4/1976 Armstrong ..... E02F 3/425 414/712
4,053,075 A * 10/1977 Stedman ..... E02F 3/3405 414/707
4,054,216 A * 10/1977 Inui ..... E02F 3/3405 414/697
4,316,697 A * 2/1982 Yokoyama ..... E02F 3/30 414/707
4,318,663 A * 3/1982 Waite ..... E02F 3/437 414/707
4,947,956 A 8/1990 Henline
6,715,579 B1 4/2004 Hendron
(Continued)

*Primary Examiner* — Saul Rodriguez
*Assistant Examiner* — Brendan P Tighe
(74) *Attorney, Agent, or Firm* — Tomlinson McKinstry, P.C.

(57) ABSTRACT

An articulating work vehicle with a radially-pivoting lift arm, attached to a radially-pivoting base. The vehicle has a wheeled back section, on which an operator may stand, and a front, tool-carrying section, connected to the back section by an articulation joint. The front section has a system of actuators. These actuators cause a base tower to pivot relative to a frame, and a loader arm to pivot relative to the base tower. A tool, carried by the loader arm, may be self-levelling, and a bell crank allows the loader arm actuator's reaction point to float relative to the base tower.

17 Claims, 7 Drawing Sheets

(56) References Cited

U.S. PATENT DOCUMENTS

| | | | | |
|---|---|---|---|---|
| 8,485,287 | B2 | 7/2013 | Sewell | |
| 9,528,242 | B2 * | 12/2016 | Oyama | E02F 3/433 |
| 10,293,853 | B2 | 5/2019 | Koike et al. | |
| 2004/0091347 | A1 * | 5/2004 | Hackett | B66C 1/585<br>414/685 |
| 2007/0031233 | A1 * | 2/2007 | Frey | E02F 3/422<br>414/685 |
| 2007/0132204 | A1 * | 6/2007 | Sewell | A01B 51/026<br>280/418 |

* cited by examiner

ATTACHMENT FRAME WITH PIVOTING LOADER ARM

SUMMARY

The present invention is directed to an articulated work vehicle. The vehicle comprises a main frame, a first frame, a base section, a loader arm, a bucket, a first actuator, a second actuator, and a third actuator. The first frame is pivotally connected to the main frame about a substantially vertical axis. The base section is pivotally connected to the first frame about a first substantially horizontal axis. The loader arm is pivotally connected to the base section about a second substantially horizontal axis. The bucket is pivotally connected to the loader arm about a third substantially horizontal axis.

In this embodiment, the first actuator is directly attached to the frame and configured to rotate the base about the first substantially horizontal axis. The second actuator is attached to the base and configured to rotate the loader arm about the second substantially horizontal axis. The third actuator is configured to rotate the bucket about the third substantially horizontal axis.

In another aspect, the invention is directed to a work vehicle. The work vehicle comprises a mainframe, configured for standing operation, an articulation joint attached to the mainframe, and a front assembly pivotally attached to the main frame by the articulation joint.

The front assembly comprises a frame, a base, and a loader arm. The frame has a plurality of ground-contacting drive members. The base is pivotally attached to the frame about a first axis, where the first axis is substantially horizontal. The loader arm is pivotally attached to the base about a second axis, where the second axis is also substantially horizontal.

In another aspect the invention is directed to a lift arm assembly. The lift arm assembly comprises a frame, a base, a first actuator, a loader arm, and a second actuator. The base is pivotally attached to the frame about a substantially horizontal axis. The first actuator is attached at a first end to the base and at a second end to the frame. The loader arm is pivotally attached to the base about a substantially horizontal axis. The second actuator is attached at a first end to the loader arm, and configured to pivot the loader arm relative to the base.

DETAILED DESCRIPTION

Certain industries such as construction and demolition require mass transportation of loads and bulky materials. While there are many ways to move these materials, motorized equipment is frequently used to get the job done. Though motorized vehicles such as skid steers and articulating vehicles are popular, they present specific challenges and drawbacks. Some of these limitations include destructive paths from wheels or tracks, dangerous tipping points due to poor balance, and limited paths of motion. Thus, there is a need for a more efficient way to transport materials while maintaining the safety of the operator and preserving jobsite turf.

Figure 1:
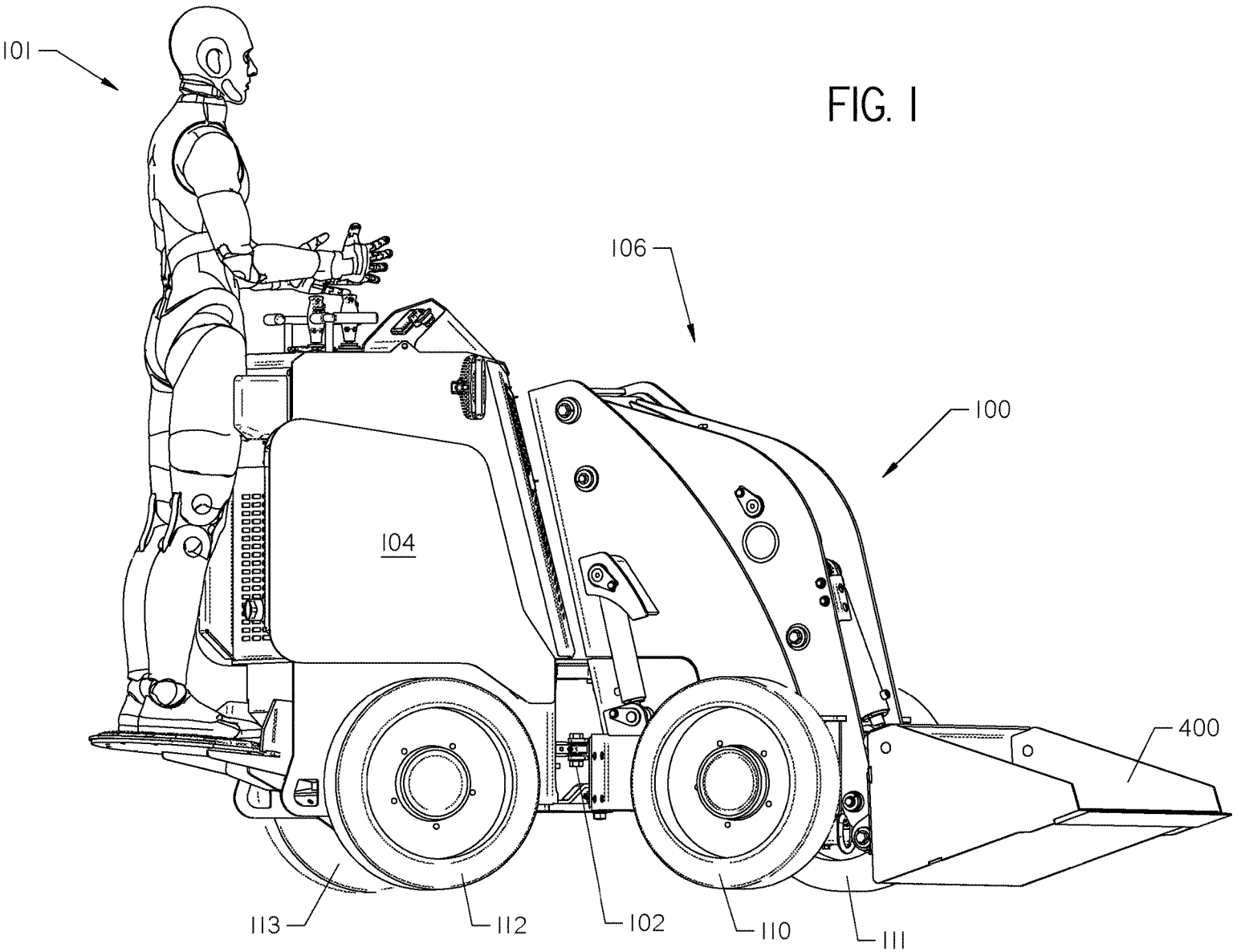
FIG. 1 is a perspective view of an articulated work vehicle being operated by a person.

Turning now to the figures and the present invention, FIG. 1 shows an operator 101 moving an electric articulating tool vehicle 100. While an articulating work vehicle 100 is shown, other types of vehicles can be utilized with the arms of the present invention. The vehicle 100 comprises a front lift arm section 106 and rear main frame section 104 connected by an articulation joint 102. The articulation joint 102 allows the front section 106 and rear section 104 to pivot about a substantially vertical axis. The front section 106 comprises front wheels 110 and in and the rear section 104 comprises rear wheels 112 and 113 that are capable of rotating at different speeds and directions from one another. Tracks may also be utilized.

The present invention provides improvements to the lift arm assembly 600 of the tool vehicle 100. The lift arm assembly 600 is supported on the front section 106 of the vehicle 100. In order to lower materials into trash dumpsters, the tool vehicle 100 may have to reverse while lowering the lift arm to avoid hitting the dumpster. This could be problematic, as the operator would have to focus on driving the vehicle 100 while also lowering the lift arm, increasing the risk of tipping or damaging the surrounding areas. Thus, current lift arms' limitations make it challenging to operate articulating tool vehicles carrying heavy loads. Improved arm designs are needed to increase the reliability of tool vehicles.

Figure 2:
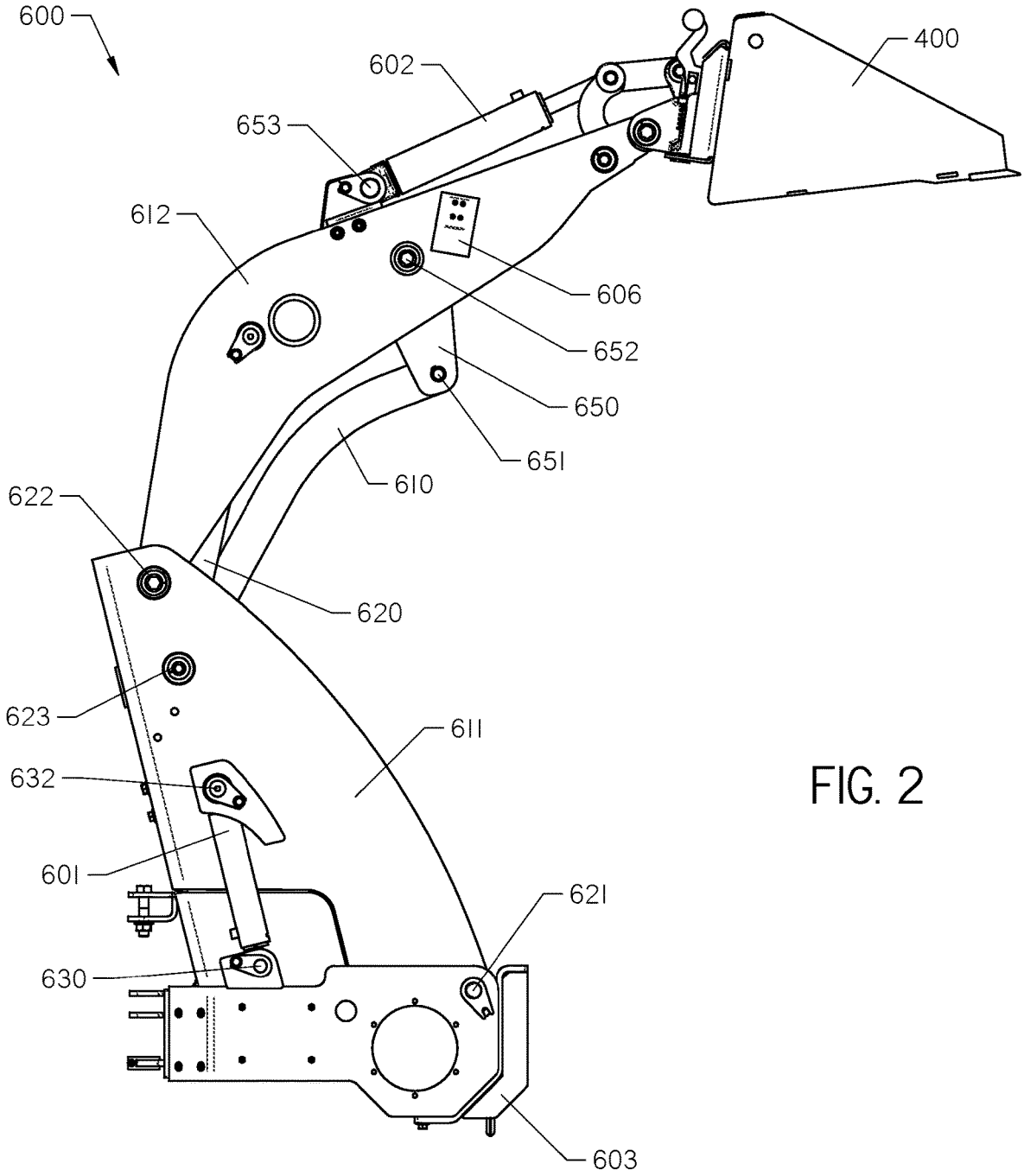
FIG. 2 is a side view of a first embodiment of a lift arm of the vehicle while base actuators are in the compressed position.
Figure 3:
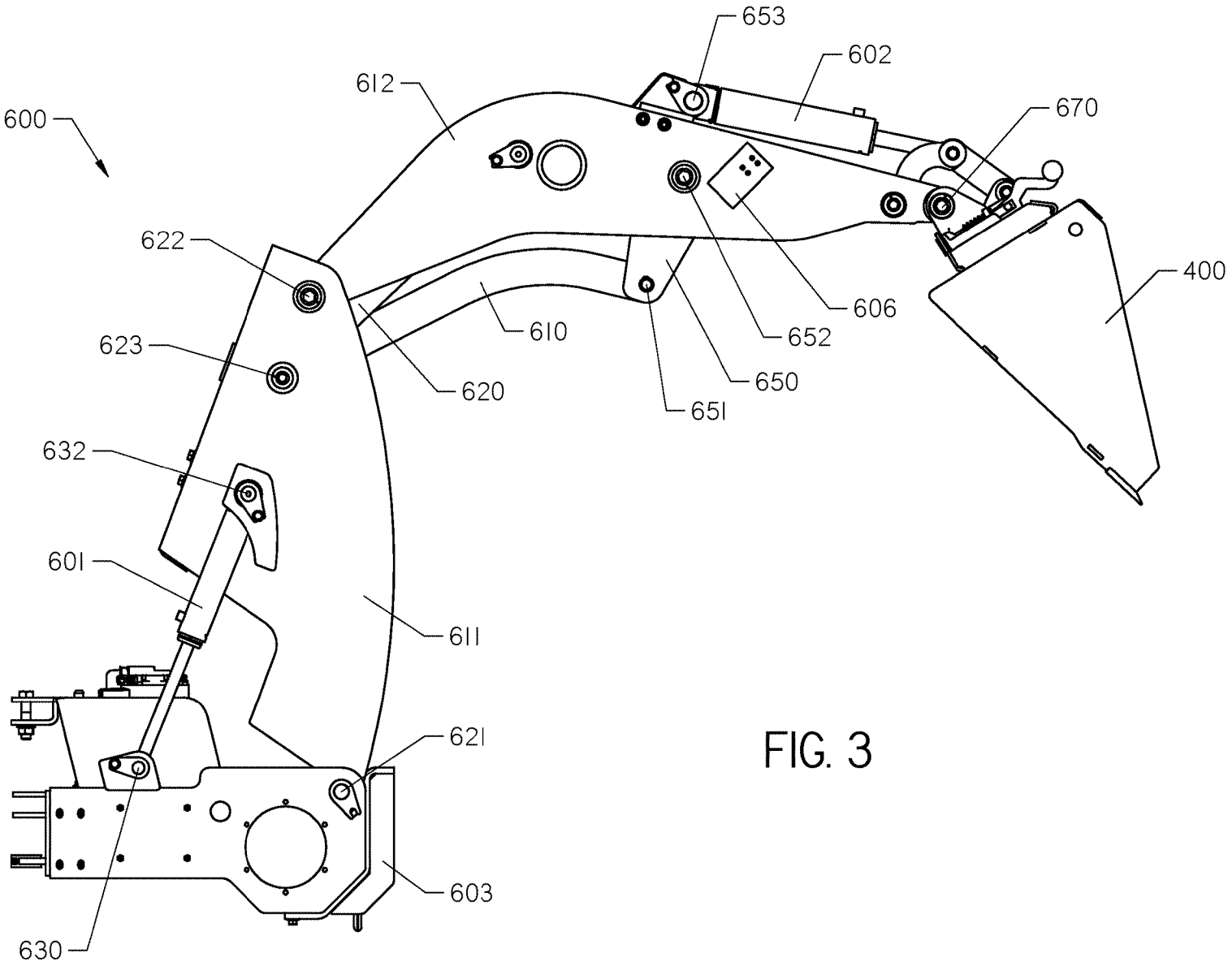
FIG. 3 is a side view of the lift arm of the vehicle while the base actuators are in the fully extended position.
Figure 4:
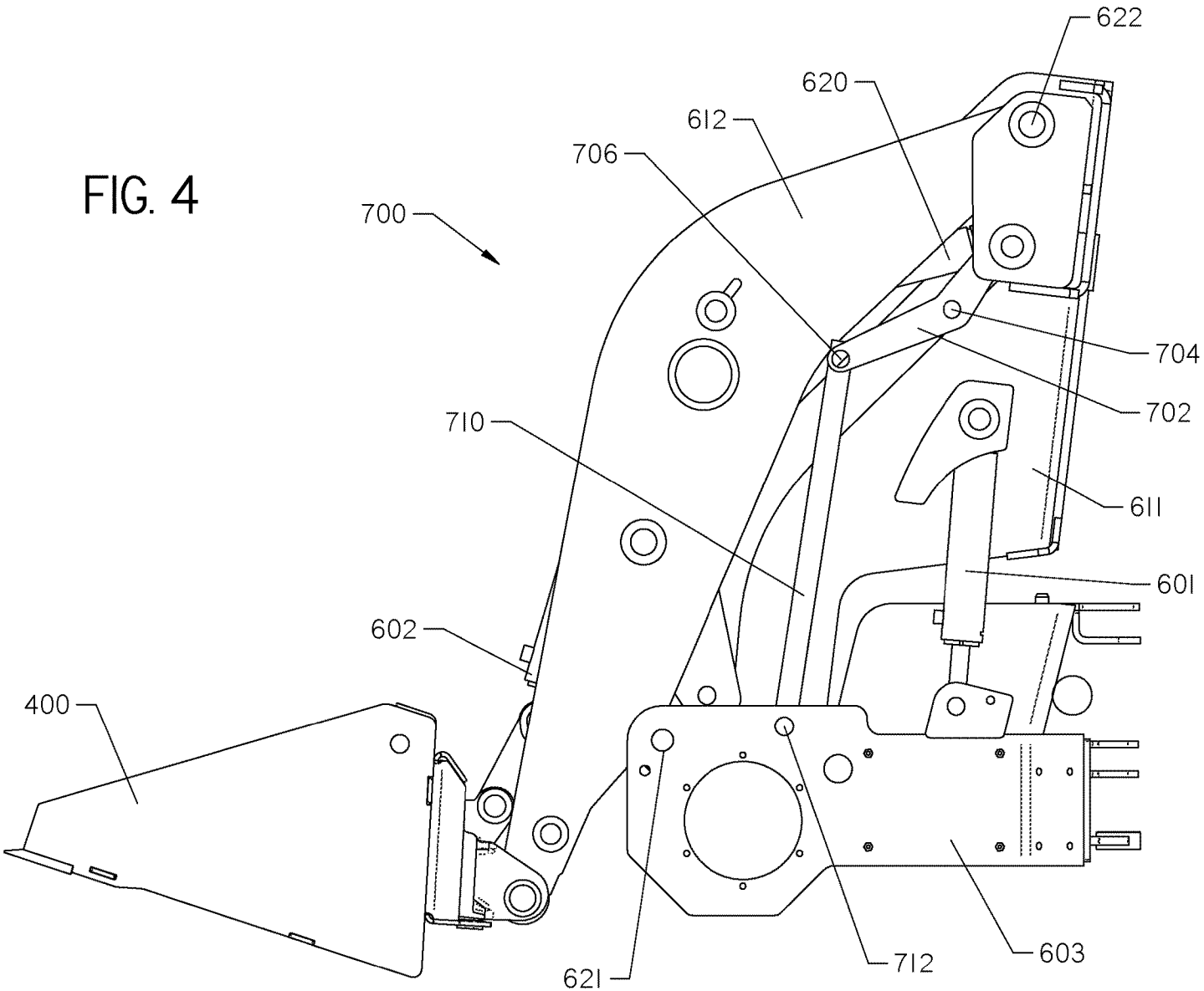
FIG. 4 is a side view of an alternative embodiment of the lift arm assembly with a portion of the tilting base removed such that a bell crank linkage can be seen. The lift arm is in the lowered position.
Figure 5:
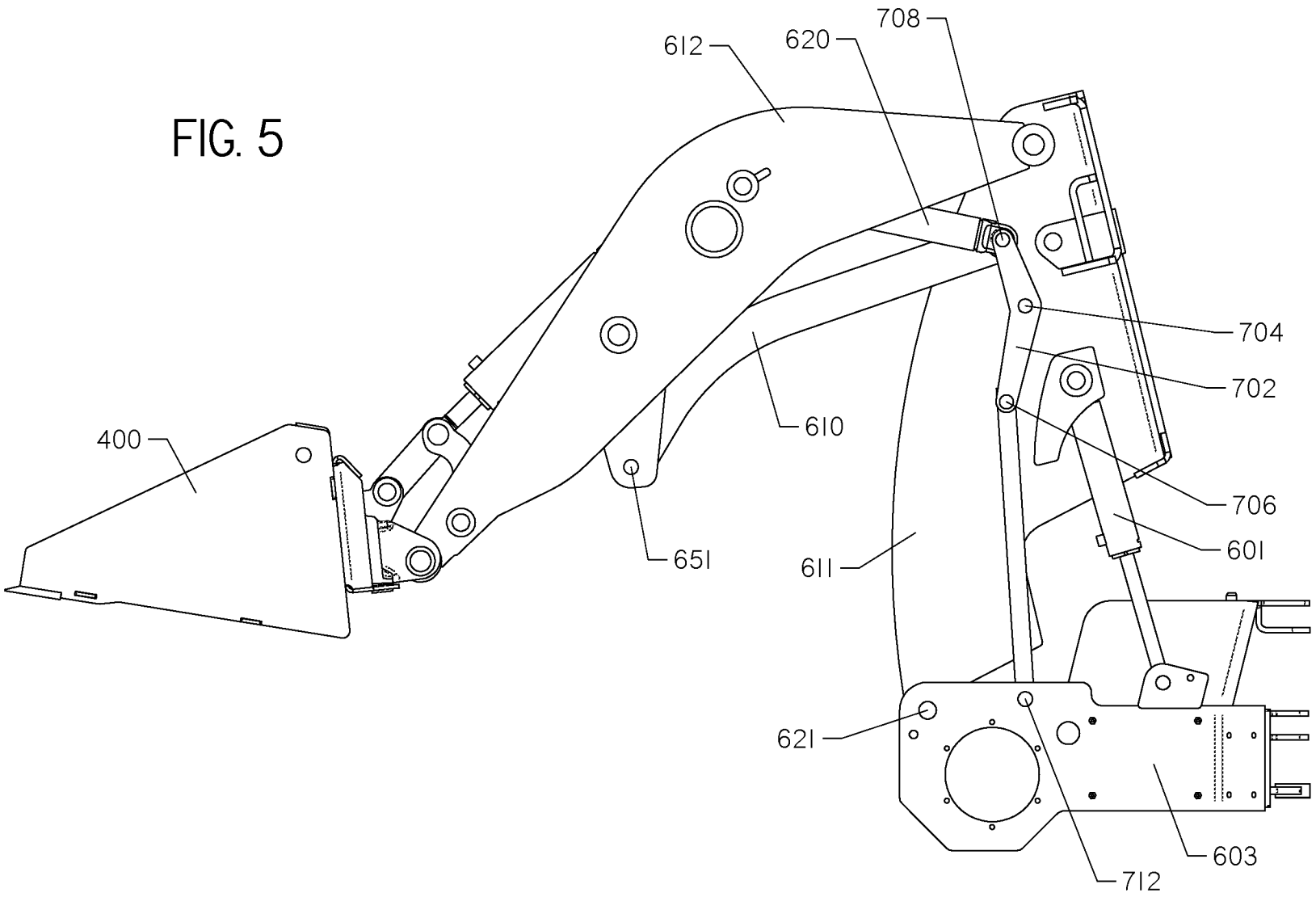
FIG. 5 is a side view of the embodiment of FIG. 4, with the actuators for the loader arm and tilting base partially extended.
Figure 6:
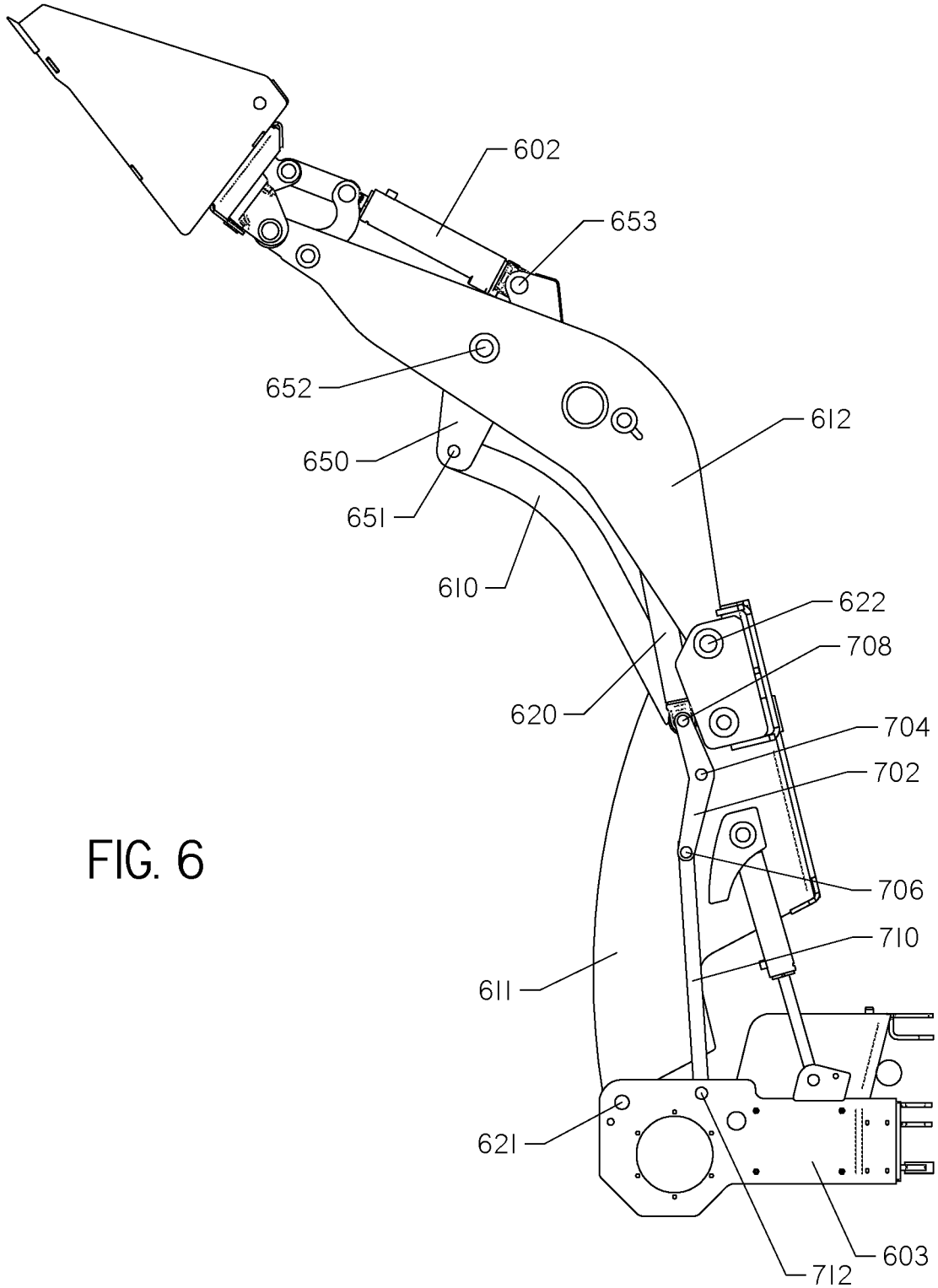
FIG. 6 is a side view of the embodiment of FIG. 4, with the actuators for the loader arm and tilting base fully extended. The tilt cylinder is fully retracted.

As shown in FIGS. 1-3, the lift arm assembly 600 has base actuators 601, a tool actuator 602, and a loader arm actuator 620. The lift arm 600 is comprised of a pivoting base 611, a loader arm 612, and a tool 400, in this case, a bucket. Actuator 601 is attached at a first end 630 to a front section 603 of the articulating tool vehicle 100 and at a second end 632 to the pivoting base 611. Thus, as actuator 601 extends, the pivoting base 611 pivots forwards and up, away from the front section 603 about pivot point 621. Pivot point 621 allows the radial rotation of the base 611 about a substantially horizontal "first axis" passing through point 621.

Figure 7:
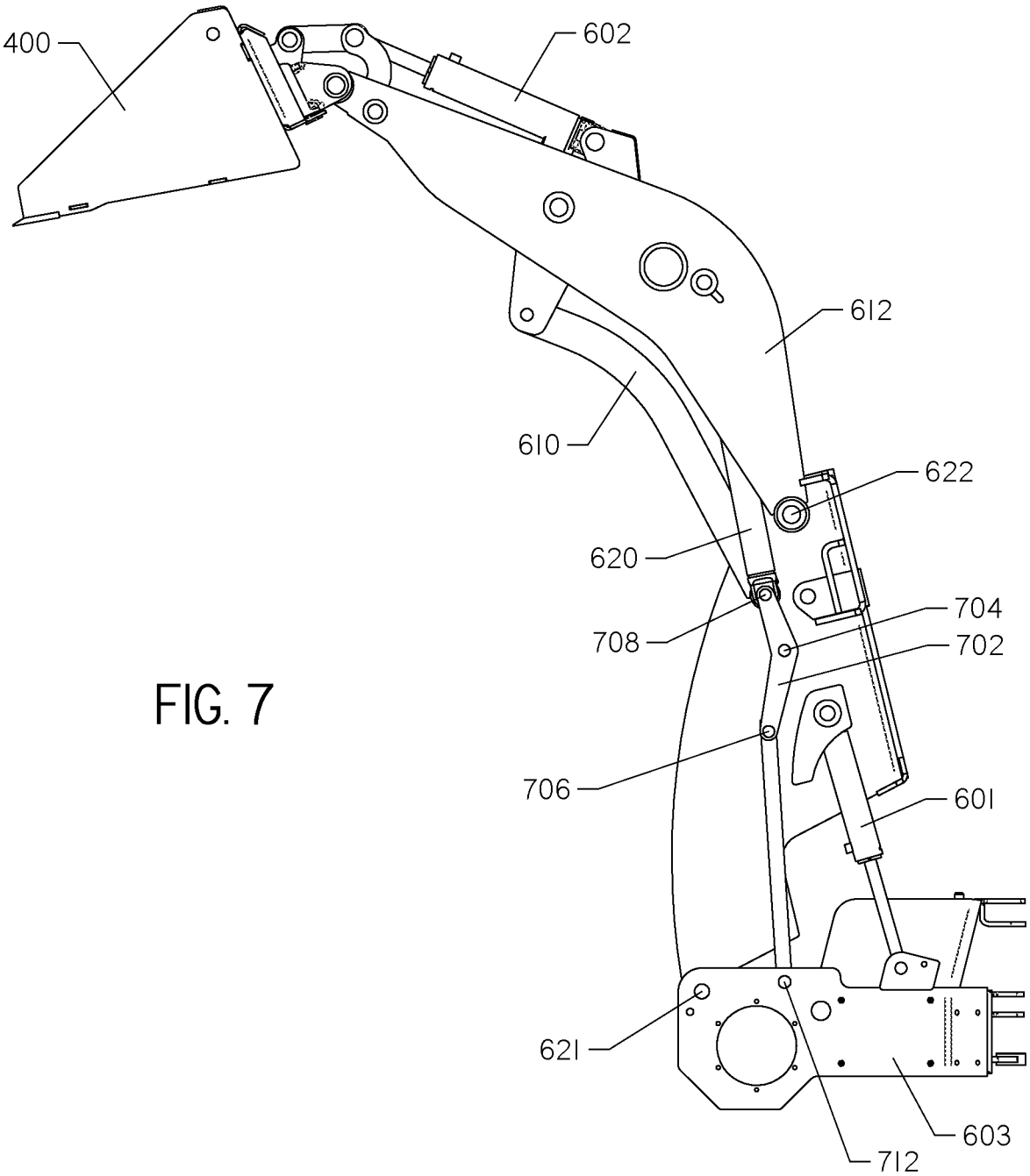
FIG. 7 is a side view of the embodiment of FIG. 4, in the same orientation as shown in FIG. 6, but with the tilt cylinder extended.

The loader arm 612 is radially attached to the pivoting base 611 at pivot point 622. Pivot point 622 allows the radial rotation of the loader arm 612 relative to the base 611 about a substantially horizontal "'second axis" passing through point 622. Extension and retraction of loader arm actuator 620 (FIG. 7) causes the loader arm to rotate and raise. The bucket 400 may then be tilted by extension of tool actuator 602.

A tilt member 610 extends between the pivoting base 611 and a self-leveling mechanism 650 attached at the loader arm 612. The tilt member 610 pivots about pivot point 623 and extends to point 651 on the mechanism 650. The mechanism 650 is itself attached to the loader arm 612 at point 652. The tilt cylinder 602 is attached to the mechanism 650 at point 653. In this way, the bucket 400 remains in a single configuration relative to the pivoting base 611 while the loader arm 612 is lifted. The bucket 400 is therefore somewhat "self-levelling", that is—it is ordinarily only tilted relative to ground level by actuation of the tool actuator 602, but the tilt mechanism 650 allows it to pivot about point 670 in a manner which allows it to remain "level".

Sensors 606 are also attached throughout the lift arm 600 to record variable measurements such as pressure and acceleration. By using accelerometers and/or gyroscope sensors combined with other types of sensors such as pressure sensors, the control system can limit the lift arm's 600 motion at certain incline and articulation angles to avoid tipping. The tool vehicle's velocity may also be limited at certain articulation angles to reduce the risk of tipping. Thus, with the improved lift arm 600, the present invention allows the vehicle 100 to lift and lower loads in safer and more efficient ways.

With reference to FIGS. 4-7, an alternative embodiment of the tool vehicle 100 lift arm apparatus 700 is shown. The near cover of the pivoting base 611 (FIGS. 2-3) is removed so that internal components of the radially-tilting linkage can be shown.

It is important to note what is common between the lift arm apparatus 600 and lift arm apparatus 700. Namely, the pivoting base 611 rotates about point 621 due to extension of base actuator 601. Likewise, the loader arm 612 pivots about point 622 due to actuation of loader arm actuator 620. Extension and retraction of tilt actuator 602 tilts the bucket or other tool 400.

A bell crank 702 is utilized to move the pivot point of the loader arm actuator 602. The bell crank 702 has three pivot points, 704, 706, 708. The pivot point 704 is fixed in position relative to the pivoting base 611 and tied thereto. The pivot points 706, 708 thus rotate about the fixed pivot point 704.

The pivot point 706 is attached to bell crank linkage 710. The bell crank linkage 710 establishes a fixed distance between pivot point 706 and a pivot point 712 on the front section 603. As shown, the pivot point 712 is disposed closer to the articulation joint 102 than pivot point 621.

As best shown in FIGS. 5-8, the loader arm actuator 620 and tilt member 610 are attached to the bell crank 702 at the pivot point 708, and not to a point on the tilting base 611, as in the embodiment of FIGS. 2-3. This configuration allows the pivot point 708, and thus the ends of the tilt member 610 and loader arm cylinder 620, to move forward of the position 623 (FIGS. 2-3). It should be understood that the cylinder 620 and tilt member 610 may be "attached to" the bell crank 702 indirectly through a structural element, but that point 708 will remain common to the bell crank 702, actuator 620, and tilt member 610 throughout the lifting process. The lift path of the tool 400 is thus higher at the end of the extension of cylinders 601, 620 while maintaining the radial attachment of the tilting base 611 and loader arm 612.

Changes may be made in the construction, operation and arrangement of the various parts, elements, steps and procedures described herein without departing from the spirit and scope of the invention as described in the following claims. The phrase "substantially vertical" and "substantially horizontal" should be understood to mean, when the assembly or vehicle is on a flat surface, "vertical" and "horizontal", within ordinary machining tolerances. The phrase "substantially vertical/horizontal" is not so broad as to encompass a pivot axis which is intentionally skewed. The word "attached" or "connected", when used without the adverb "directly", does not require direct, element-on-element contact, as intermediate components may facilitate such connection or attachment.

The invention claimed is:

1. A lift arm assembly comprising:
- a frame;
- a base, pivotally attached to the frame about a substantially horizontal axis;
- a first actuator directly attached at a first end to the base and at a second end to the frame;
- a loader arm pivotally attached to the base about a substantially horizontal axis;
- a second actuator attached at a first end to the loader arm, configured to pivot the loader arm relative to the base; and
- a bell crank attached at a center position to the base, and at a distal position to the second actuator at a second end of the second actuator.

2. The lift arm assembly of claim 1 further comprising a linkage disposed between the bell crank and the frame.

3. The lift arm assembly of claim 1 further comprising:
- a tool disposed on the loader arm; and
- a third actuator attached at a first end to the loader arm and at a second end to the tool.

4. The lift arm assembly of claim 3 further comprising:
- a tilt member, attached at a first end to the bell crank at the distal position; and
- a leveling mechanism, pivotally attached to the loader arm and having a first end and a second end; wherein:
  - the first end is attached to the tilt member; and
  - the second end is attached to the third actuator.

5. The lift arm assembly of claim 3 in which the tool comprises a bucket.

6. An articulated vehicle, comprising:
- a main frame comprising a first ground engaging member;
- an articulation joint disposed on the main frame; and
- the lift arm assembly of claim 1, pivotally attached to the main frame through the articulation joint wherein the frame of the lift arm assembly comprises a second ground engaging member.

7. The articulated vehicle of claim 6 in which the main frame is configured for a standing operator.

8. A work vehicle, comprising:
- a mainframe, configured for standing operation and having at least one ground-engaging wheel;
- an articulation joint attached to the mainframe;
- a front assembly pivotally attached to the mainframe by the articulation joint and comprising:
  - a frame having a plurality of ground-contacting drive members;
  - a base, pivotally attached to the frame about a first axis, wherein the first axis is substantially horizontal; and
  - a loader arm, pivotally attached to the base about a second axis, wherein the second axis is substantially horizontal; and
- a bell crank having a first end, a second end, and a center attachment point, and wherein:
  - the bell crank is attached to the base at the center attachment point; and
  - the bell crank is attached to the second actuator at the first end.

9. The work vehicle of claim 8 further comprising:
- a first actuator disposed between the frame and the base and directly attached to the frame and to the base; and
- a second actuator configured to pivot the loader arm about the second axis.

10. The work vehicle of claim 9 in which the second actuator is disposed between the base and the loader arm.

11. The work vehicle of claim 9 in which the second axis is disposed closer to the mainframe than the first axis.

12. The work vehicle of claim 8 further comprising a linkage, in which the linkage is disposed between the frame and the second end of the bell crank.

13. The work vehicle of claim 12 in which the first axis is positioned further from the articulation joint than a connection point between the linkage and the frame.

14. An articulated work vehicle comprising:

a main frame;

a first frame pivotally connected to the main frame about a substantially vertical axis;

a base section pivotally connected to the first frame about a first substantially horizontal axis;

a loader arm pivotally connected to the base section about a second substantially horizontal axis;

a bucket pivotally connected to the loader arm about a third substantially horizontal axis;

a first actuator directly attached to the first frame and configured to rotate the base section about the first substantially horizontal axis;

a second actuator attached to the base section and configured to rotate the loader arm about the second substantially horizontal axis;

a bell crank, having a first connection point, a second connection point, and a third connection point, wherein the second connection point is disposed between the first connection point and the third connection point; wherein:

the second connection point is directly attached to the base section; and the third connection point is coaxial with an end of the second actuator; and a third actuator configured to rotate the bucket about the third substantially horizontal axis.

15. The articulated work vehicle of claim 14, further comprising:

a linkage, attached at a first end to the frame about a fourth substantially horizontal axis, wherein the first connection point of the bell crank is attached to the linkage.

16. The articulated work vehicle of claim 15, further comprising:

a tilt mechanism having a first connection point, a second connection point, and a third connection point, wherein the second connection point is disposed between the first connection point and the third connection point, and wherein the tilt mechanism is pivotally attached to the loader arm about the second connection point of the tilt mechanism; and a tilt linkage directly connected to the third connection point of the bell crank and the third connection point of the tilt mechanism;

wherein the third actuator is connected to the first connection point of the tilt mechanism.

17. The articulated work vehicle of claim 14, in which the first actuator and the second actuator are defined by an extended condition and a retracted condition, and wherein:

with both the first actuator and the second actuator in the extended condition, the third substantially horizontal axis is above and forward of both the first substantially horizontal axis and the second substantially horizontal axis; and with both the first actuator and the second actuator in the retracted condition, the third substantially horizontal axis is below and forward of both the first substantially horizontal axis and the second substantially horizontal axis, and the second substantially horizontal axis is above and behind the first substantially horizontal axis.

* * * * *